United States Patent [19]

Johnston et al.

[11] Patent Number: 4,651,822

[45] Date of Patent: Mar. 24, 1987

[54] DUMP AND KILL VALVE FOR A SIDEPOCKET MANDREL

[75] Inventors: Russell A. Johnston, Houston; Dwayne E. May, Humble, both of Tex.

[73] Assignee: Camco, Incorporated, Houston, Tex.

[21] Appl. No.: 855,194

[22] Filed: Apr. 23, 1986

[51] Int. Cl.[4] ..... E21B 34/10; E21B 23/03

[52] U.S. Cl. ..... 166/117.5; 166/317; 166/322; 166/323

[58] Field of Search ..... 166/117.5, 117.6, 317, 166/319, 322, 323

[56] References Cited

U.S. PATENT DOCUMENTS

| | | | |
|---|---|---|---|
| 3,086,593 | 4/1963 | Chitwood | 166/319 |
| 3,958,633 | 5/1976 | Britch et al. | 166/117.5 |
| 4,039,031 | 8/1977 | Crowe | 166/317 |
| 4,066,128 | 1/1978 | Davis et al. | 166/117.5 X |
| 4,359,094 | 11/1982 | Risinger | 166/319 X |
| 4,524,831 | 6/1985 | Pringle | 166/117.5 X |
| 4,527,631 | 7/1985 | Vazquez | 166/117.5 X |

*Primary Examiner*—Stephen J. Novosad

*Attorney, Agent, or Firm*—Fulbright & Jaworski

[57] ABSTRACT

A dump and kill valve for use in a sidepocket having a main bore, a sidepocket in communication with the main bore with ports between the sidepocket and the outside of the mandrel and a shoulder above the pocket. The valve includes a body having a no-go shoulder with an upper first and a lower second seal spaced apart and positioned on the body sealing in the pocket on opposite sides of the port for initially blocking fluid flow. One of the seals is releasably connected to the body and is movable relative to the body upwardly in response to fluid pressure for opening communication between the ports and the main bore. Latch means may be provided between the movable seal and the body for latching the movable seal after opening and the setting tool may include a releasable seal holding shoulder for preventing premature movement of the movable seal.

9 Claims, 6 Drawing Figures

DUMP AND KILL VALVE FOR A SIDEPOCKET MANDREL

BACKGROUND OF THE INVENTION

Sometimes it becomes desirable to pump kill fluids from the annulus between the casing and well tubing of an oil and/or gas well and into the tubing for killing the well. One type of valve used is a retrievable valve set in the sidepocket of a mandrel in which a piston is pumped downwardly out of the bottom of the sidepocket to provide communication between the annulus and the tubing. However, the sidepocket of a mandrel is frequently positioned at a weld which causes buildup at the lower end of the mandrel pocket. While such a welding buildup does not affect the passage of fluids, the buildup may block the physical movement of a downwardly moving piston thereby preventing the piston from moving out of the lower end of the sidepocket and establishing communication between the sidepocket and the tubing bore.

The present invention is directed to a dump and kill valve for use in a sidepocket of a mandrel which moves upwardly in the smooth polished bore of the sidepocket for ease of movement for opening the sidepocket to a full flow of kill fluid.

SUMMARY

The present invention is directed to a dump and kill valve for use in a sidepocket mandrel having a main bore and a sidepocket in communication with the main bore with ports between the pocket and the outside of the mandrel and a shoulder positioned above the pocket. The valve includes a body having a no-go shoulder for engaging the mandrel shoulder, upper first and lower second seal means spaced apart and positioned on the body for sealing in the pocket on opposite sides of the ports for initially blocking fluid flow from the outside of the pocket to the main bore. One of the seals is releasably connected to the body and is movable relative to the body upwardly in response to an increase in fluid pressure applied to the outside of the mandrel for opening communication between the ports and the main bore. Releasable lock means are provided on the body for releasably locking the body to the mandrel.

A still further object of the present invention is wherein the upper seal is movable out of the upper end of the sidepocket for providing communication between the ports and the upper end of the sidepocket and the releasable lock is adjacent the bottom of the body for avoiding interference with the movable upper seal, and a debris shield is movable on the body above the upper seal and is engagable with the top of the pocket for preventing debris from settling on the upper seal.

Yet a further object of the present invention is wherein the lower seal is movable upwardly past the ports for providing communication between the ports and the lower end of the sidepocket.

Still a further object of the present invention is wherein coacting latch means are provided between the movable seal and the body for latching the movable seal in the open position after fluid communication is opened.

Yet a still further object of the present invention is the provision of a setting tool for installing the valve in the sidepocket in which the setting tool includes a seal holding shoulder releasably positioned adjacent the movable seal for preventing premature movement of the movable seal while installing the valve in the sidepocket.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENTS

Figure 1:
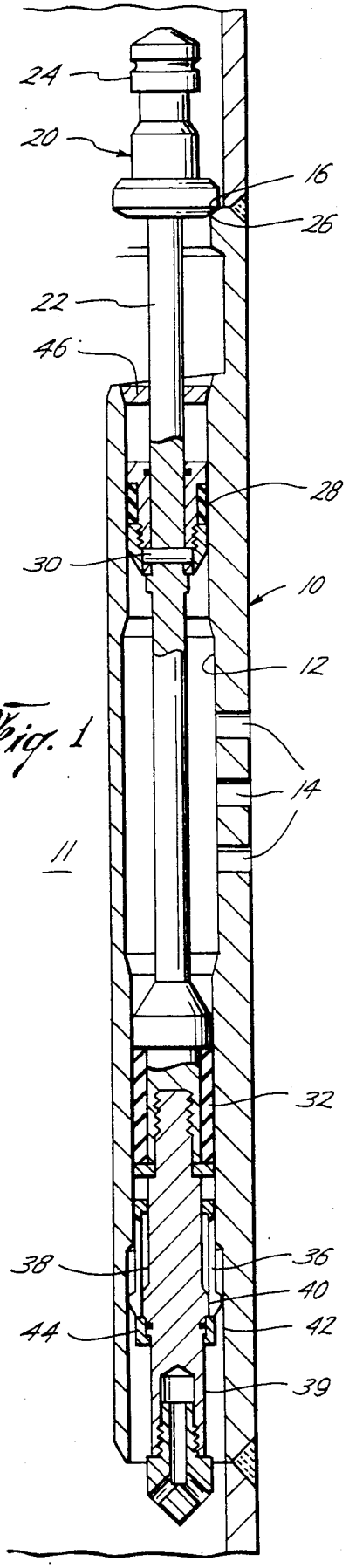
FIG. 1 is a fragmentary elevational view, partly in cross section, illustrating one embodiment of the dump and kill valve of the present invention installed in position in a sidepocket mandrel blocking flow therethrough.
Figure 2:
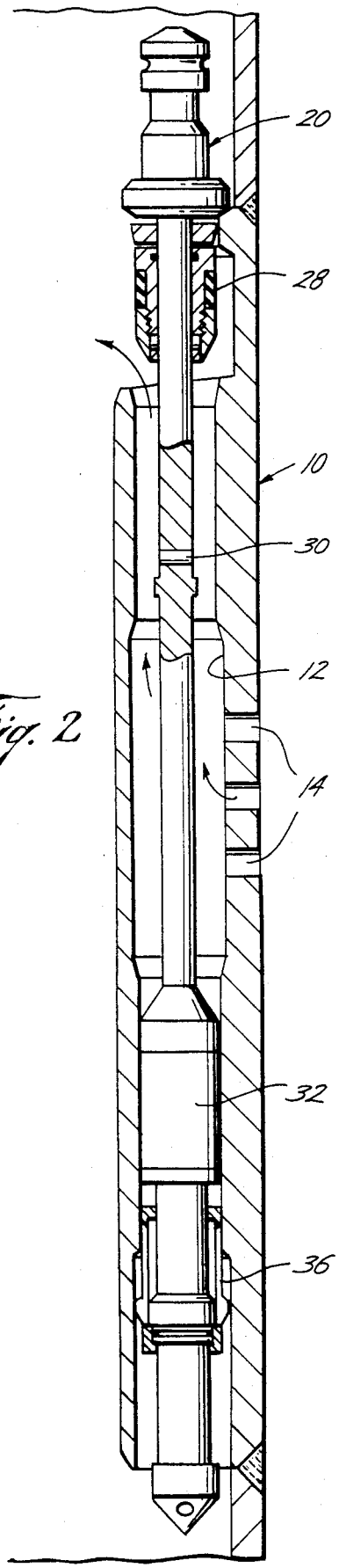
FIG. 2 is a view similar to FIG. 1 showing the valve in the open position.

Referring now to the drawings and particularly to FIGS. 1 and 2, the reference numeral 10 generally indicates a portion of a conventional sidepocket mandrel such as the type KBMG sold by Camco, Incorporated, and which includes a main bore 11, a sidepocket 12 normally in communication with the main bore both at the top and bottom of the sidepocket 12, port 14 between the pocket 12 and the outside of the mandrel and a shoulder 16 positioned above the pocket 12. The valve of the present invention is generally indicated by the reference numeral 20 and includes a body 22, a running and pulling head 24 attached thereto, and a no-go shoulder 26 for engaging the mandrel shoulder 16 for positioning the valve in the sidepocket 12. The valve 20 may be installed and removed from the sidepocket 12 by any suitable kickover tool such as disclosed in U.S. Pat. No. Re. 29,870.

The valve includes a first upper seal 28 which is secured to the body 22 by releasable means such as a shear pin 30 and a second lower seal 32 which is fixedly secured to the body 22. The seals 28 and 32 are spaced apart and positioned on the body 22 for sealing in the polished bores of the sidepocket on opposite sides of the ports 14. As initially positioned, the seals 28 and 30 block fluid communication between the annulus outside of the mandrel 10 and the main bore 11 of the mandrel 10.

One of the seals, here shown as seal 28, which is releasably connected to the body 22 is movable upwardly relative to the body 22 when the shear pin 30 is sheared. The application of pressure in a well bore in the annulus is applied to the ports 14 and a predetermined pressure will shear the pin 30 and move the upper seal 28 out of the upper end of the sidepocket 12 opening communication between the ports 14 and the main bore 11 of the mandrel 10.

As best shown in FIG. 2, when increased fluid pressure is pumped through the ports 14, the shear pin 30 is sheared and the seal 28 moves out of the top of the sidepocket 12.

Releasable locking means are provided for locking the valve 20 in the sidepocket. Such means may include a collet lock 36 in which the collet fingers are retracted against the exterior 38 of the body 22 when installing the valve 20 into the sidepocket 12 and thereafter on an upward pull the collet fingers slide downwardly over setting shoulders 40 to maintain the collet fingers 26 into locking engagement in a groove 42 in the sidepocket 12. The locking means may be released by an upward jar on the fishing net 24 which shears ring 44 and allows inward retraction of the collet fingers 36 on exterior surface 39.

A debris shield 46 may be provided slidably mounted on the body 22 and adapted to seat on the top of the sidepocket 12 for preventing debris from collecting in the sidepocket 12 on top of the piston seal 28. By the upper seal 28 moving out of the top of the sidepocket 12, a substantially larger flow area is provided than in normal conventional dump kill valves.

Figure 3A:
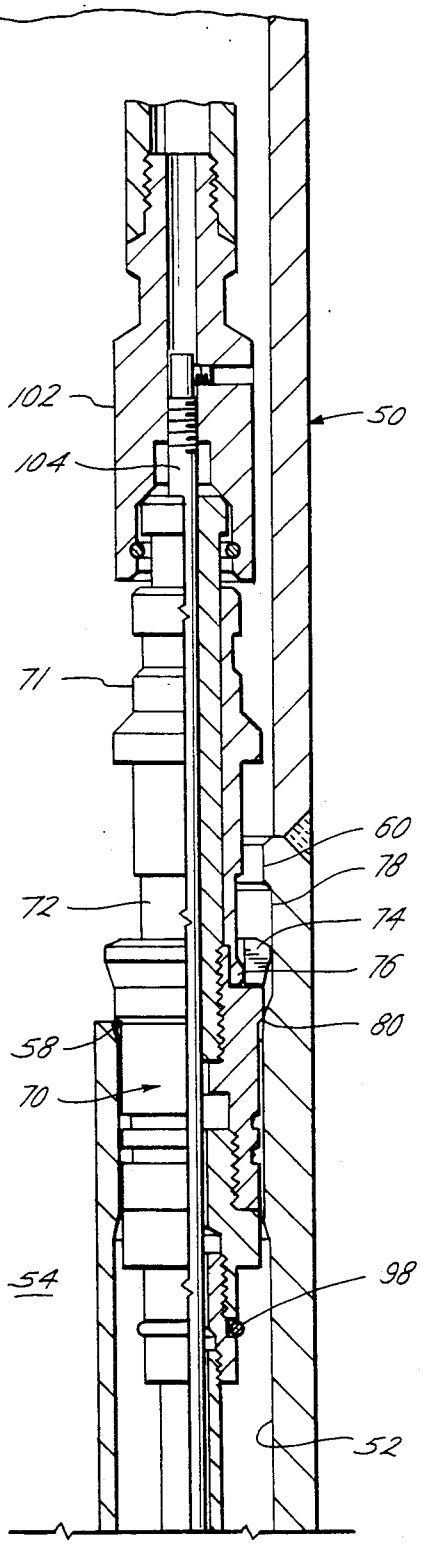
FIGS. 3A and 3B are continuations of each other and are fragmentary elevational views in quarter section, illustrating another embodiment of the valve of the present invention shown in the closed position.
Figure 3B:
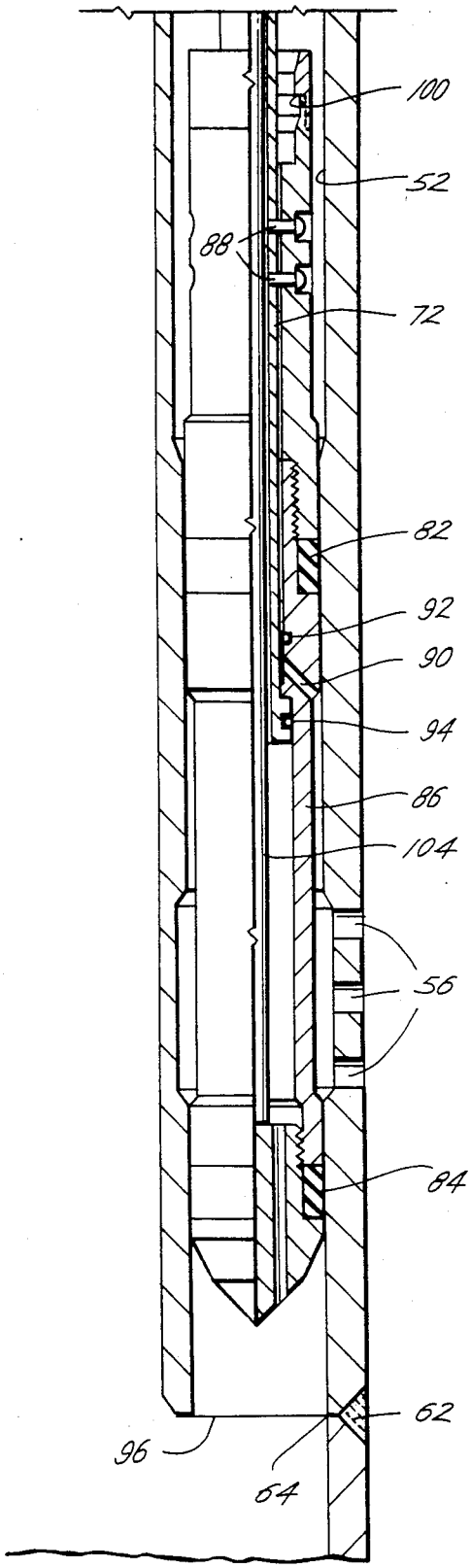

Referring now to FIGS 3A and 3B, a further embodiment of the present invention is best seen for use in a mandrel such as type MMG sold by Camco, Incorporated, which mandrel 50 has a conventional sidepocket 52, main bore 54, ports 56, a shoulder 58, and a locking shoulder 60. The sidepocket 50, as is conventional, includes a weld 62 adjacent the bottom of the mandrel 52.

The valve 70 of the present invention generally includes a body 72 and a running and pulling head 73 and releasable locking means consisting of an eccentrically moving ring 74 which is locked by fingers 76 to place the ring 74 in a groove 78 beneath the locking shoulder 60. The body 72 also includes a no-go shoulder 80 for engaging the shoulder 58 on the mandrel 50 for positioning the valve 70 properly in the sidepocket 52.

A first upper seal means 82 and a second lower seal means 84 are spaced apart and positioned on the body for sealing in the pocket 52 on opposite sides of the ports 56 for initially blocking fluid flow from the outside of the pocket into the main bore 54. Preferably, the seals 82 and 84 are connected together by a piston 86 and are movable upwardly relative to the body 72. The piston 86 is releasably connected to the body 72 such as by one or more shear pins 88.

Figure 4B:
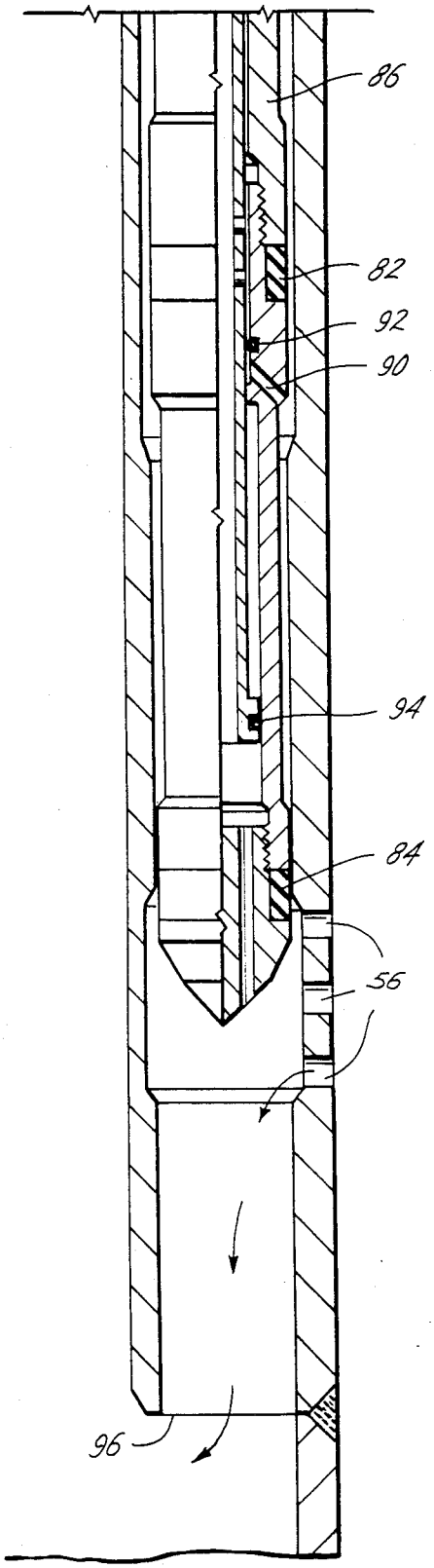
FIGS. 4A and 4B are continuations of each other showing the valve of FIGS. 3A and 3B in the open position.
Figure 4A:
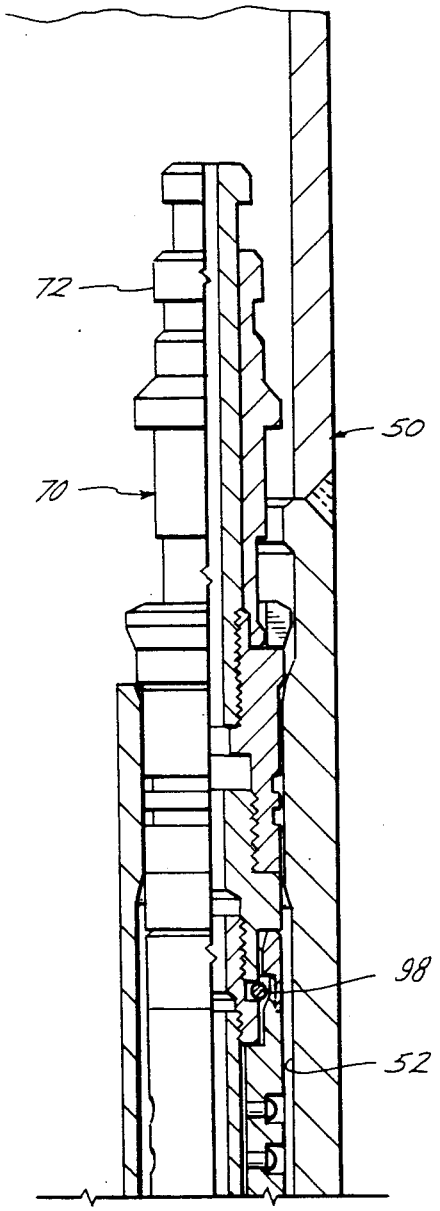

When it is desired to open the valve 70, fluid pressure in the annulus between the mandrel 50 and the casing is increased so that the pressure is applied to the ports 56 and through a passageway 90 in the piston 86 and between seals 92 and 94 causing the piston 86 to move upwardly. As best seen in FIGS. 4A and 4B, the lower seal 84 moves upwardly past the ports 56 opening fluid communication between the ports 56 and the lower end 96 of the sidepocket 52.

In addition, the valve 70 includes coacting latch means between the piston 86 and thus the movable seal 84 and the body 72 for holding the valve 70 in the open position. The latch may include a snap ring 98 and an engaging shoulder 100.

Referring again to FIGS. 3A and 3B, the setting tool 102 for setting the valve 70 may include a seal holding shoulder such as a prong 104 which abuts the movable piston 86. The prong 104 is for the purpose of allowing the valve 70 to be set in the sidepocket 52 by jarring of the setting tool 102 without prematurely shearing the shear pins 88.

After the valves 20 or 70 have been activated, they must be retrieved and redressed and installed again for use.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. A dump and kill valve for use in a sidepocket mandrel having a main bore and a sidepocket in communication with the main bore with ports between the pocket and the outside of the mandrel and a shoulder positioned above the pocket comprising, a body having a no-go shoulder for engaging the mandrel shoulder, upper first and lower second seal means spaced apart and positioned on the body for seating in the pocket on opposite sides of the ports for initially blocking fluid flow from the outside of the pocket to the main bore, one of the seals being releasably connected to the body and being movable upwardly relative to the body in response to an increase in fluid pressure applied to the outside of the mandrel for opening communication between the ports and the main bore, and releasable lock means on the body for releasably locking the body to the mandrel.

2. The apparatus of claim 1 wherein the upper seal is movable out of the upper end of the sidepocket for providing communication between the ports and the upper end of the sidepocket.

3. The apparatus of claim 2 including a debris shield movable on the body above the upper seal and engagable with the top of the pocket.

4. The apparatus of claim 3 wherein the releasable lock is adjacent the bottom of the body.

5. The apparatus of claim 2 wherein the lower seal is movable upwardly past the ports for providing communication between the ports and the lower end of the sidepocket.

6. The apparatus of claim 1 including, a setting tool for installing the valve into the sidepocket, said setting tool including a seal holding shoulder releasably positioned adjacent the movable seal for preventing premature movement of the movable seal when installing the valve in the sidepocket.

7. The apparatus of claim 1 including, coacting latch means between the movable seal and the body for latching the movable seal after opening fluid communication.

8. A dump and kill valve for use in a sidepocket mandrel having a main bore and a sidepocket in communication with the main bore with ports between the pocket and the outside of the mandrel and a shoulder positioned above the pocket comprising, a body having a no-go shoulder for engaging the mandrel shoulder, upper first and lower second seal means spaced apart and positioned on the body for sealing in the pocket on opposite sides of the ports for initially blocking fluid flow from the outside of the pocket to the main bore, one of the seals being releasably connected to the body and being movable relative to the body upwardly in response to an increase in fluid pressure applied to the outside of the mamdrel for opening communication between the ports and the main bore, releasable lock means on the body for releasably locking the body to the mandrel, coacting latch means between the movable seal and the body for latching the movable seal in the open position, and a setting tool for installing the valve in the sidepocket, said setting tool including a seal holding shoulder releasably positioned adjacent the movable seal for preventing premature movement of the movable seal when installing the valve in the sidepocket.

9. The apparatus of claim 8 wherein, the first and second seals are connected together by a piston and are movable upwardly relative to the body.

* * * * *